US010665074B1

(12) United States Patent
Kausek

(10) Patent No.: US 10,665,074 B1
(45) Date of Patent: May 26, 2020

(54) SHOOTER SUPPRESSION SYSTEM

(71) Applicant: DeFi Technologies, Inc., Beverly Hills, CA (US)

(72) Inventor: Jeffrey Kausek, Beverly Hills, CA (US)

(73) Assignee: DeFi Technologies, Inc., Beverly Hills, CA (US)

( * ) Notice: Subject to any disclaimer, the term of this patent is extended or adjusted under 35 U.S.C. 154(b) by 417 days.

(21) Appl. No.: 15/484,331

(22) Filed: Apr. 11, 2017

Related U.S. Application Data

(60) Provisional application No. 62/320,835, filed on Apr. 11, 2016.

(51) Int. Cl.

| | |
|---|---|
| ***G08B 15/00*** | (2006.01) |
| ***B05B 3/02*** | (2006.01) |
| *A62C 35/00* | (2006.01) |
| *B05B 12/00* | (2018.01) |

(52) U.S. Cl.
CPC ..... *G08B 15/00* (2013.01); *B05B 3/021* (2013.01); *A62C 35/00* (2013.01); *B05B 12/00* (2013.01)

(58) Field of Classification Search
CPC ..... G08B 15/00; B05B 3/021; B05B 12/00; A62C 35/00
See application file for complete search history.

(56) References Cited

U.S. PATENT DOCUMENTS

| | | | | |
|---|---|---|---|---|
| 5,400,688 | A | 3/1995 | Eninger et al. | |
| 6,373,385 | B1 | 4/2002 | Wheeler | |
| 7,797,116 | B2 * | 9/2010 | Berezowski | A62C 37/50 702/182 |
| 7,965,868 | B2 | 6/2011 | Roberts et al. | |
| 7,990,805 | B2 | 8/2011 | Kumhyr et al. | |
| 9,226,493 | B2 | 1/2016 | Garcia | |
| 9,297,654 | B2 * | 3/2016 | Guisewite | G01C 11/04 |
| 9,906,914 | B2 * | 2/2018 | Nagpal | H04W 4/029 |
| 10,152,877 | B2 * | 12/2018 | Linder | G08B 1/08 |

(Continued)

FOREIGN PATENT DOCUMENTS

| | | | |
|---|---|---|---|
| EP | 2429283 | B1 | 10/2013 |
| WO | 2007077474 | A1 | 7/2007 |
| WO | 2015184219 | A1 | 12/2015 |

*Primary Examiner* — Hovhannes Baghdasaryan
*Assistant Examiner* — Amie M Ndure
(74) *Attorney, Agent, or Firm* — Dicke, Billig & Czaja, PLLC

(57) ABSTRACT

A building monitoring and control system in furtherance of engaging a detected and targeted threat to persons in or about the building is provided. The system is characterized by a threat detection module, a threat targeting module, a threat tracking module, and threat engaging assemblies. The threat detection module is provided in the form of a multi-modal sensor array or network system deployable or integral with a monitored building. Threat targeting and tracking modules are operatively linked to the threat detection module, and each other. Threat engaging assemblies, in the form of water cannons selectively deployable or integral with a monitored building, are operatively linked to at least the tracking module in furtherance of disrupting a located and trackable threat with water discharged from multiple water discharge nozzles of the water cannons.

20 Claims, 7 Drawing Sheets

(56) References Cited

U.S. PATENT DOCUMENTS

| | | | | |
|---|---|---|---|---|
| 2005/0273279 | A1* | 12/2005 | Faltesek | A62C 99/009 702/51 |
| 2014/0070942 | A1* | 3/2014 | Haase | G08B 21/02 340/532 |
| 2014/0269199 | A1 | 9/2014 | Weldon et al. | |
| 2015/0061869 | A1 | 3/2015 | Crowe et al. | |
| 2015/0070166 | A1 | 3/2015 | Boyden et al. | |

* cited by examiner

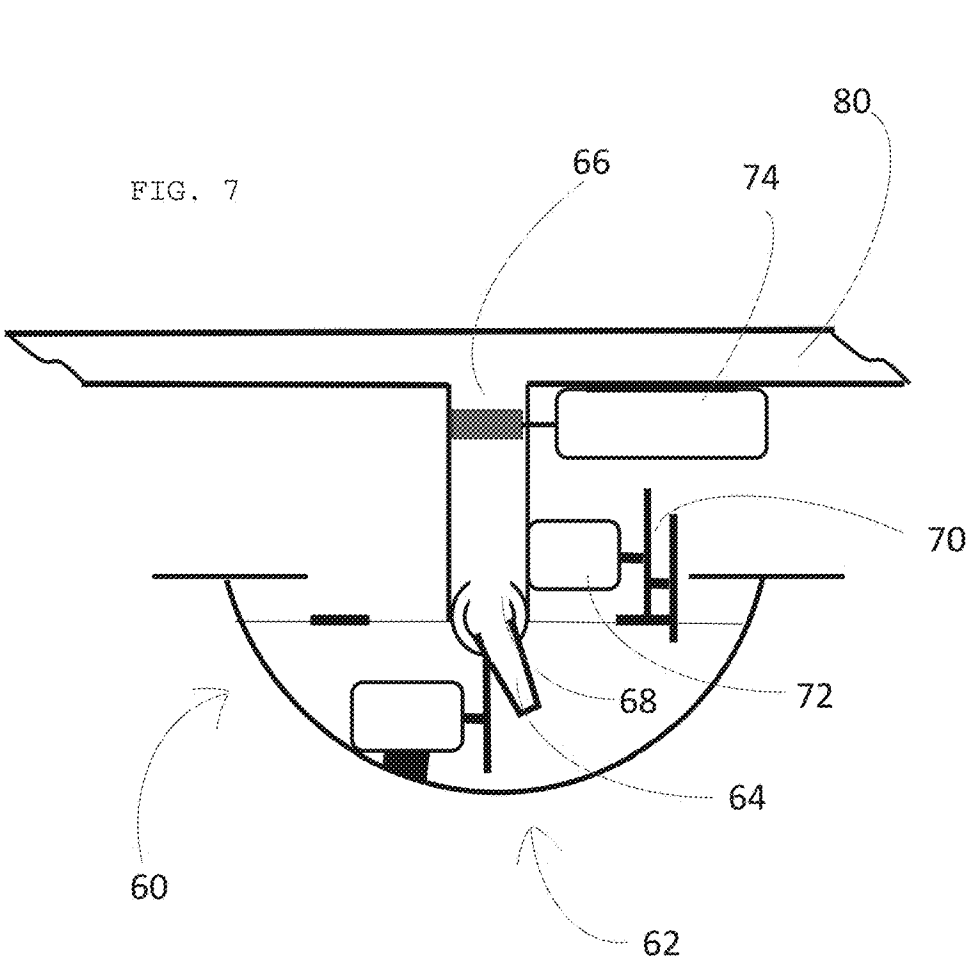
FIG. 7
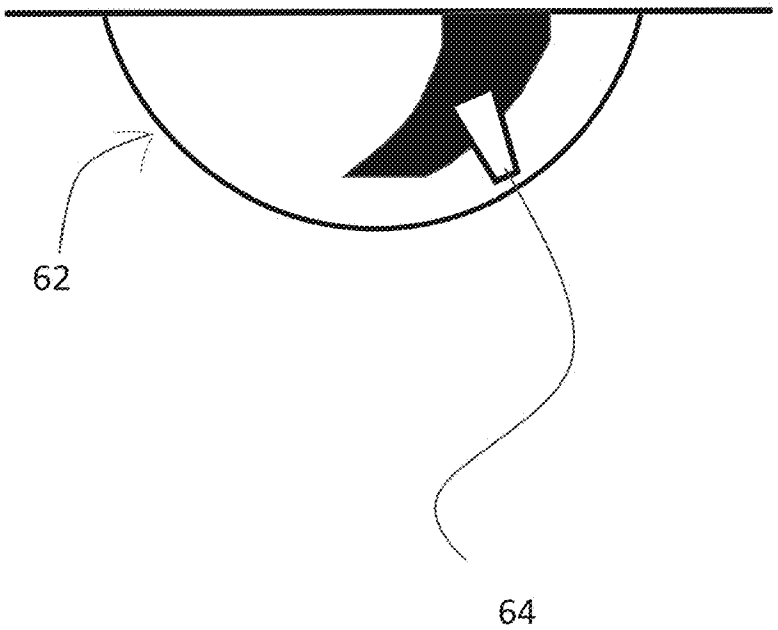

SHOOTER SUPPRESSION SYSTEM

This is a United States national patent application filed pursuant to 35 USC § 111(a) claiming priority under 35 USC § 120 of/to U.S. Pat. Appl. Ser. No. 62/320,835 filed Apr. 11, 2016 and entitled SHOOTER SUPPRESSION SYSTEM, the disclosure of which is hereby incorporated by reference in its entirety.

TECHNICAL FIELD

The present disclosure is generally directed to one or more of systems, apparatuses, devices, assemblies, subassemblies, and/or methods for/of suppressing an active shooter. More particularly, the instant disclosure is directed to one or more of systems, apparatuses, devices, assemblies, or subassemblies, alone or in combination, to detect, track, target and suppress an active shooter within or about a building via the directed dispensing of high pressure water or the like.

BACKGROUND

Threats posed by an active shooter, a term defined by the Federal Bureau of Investigation (FBI) as an individual with a firearm who attempts to kill or wound as many random people as possible in a public space, are front page news as of late, with threats ever increasing. The victim count of an active shooter event is often times only limited by the shooters ammunition capacity or the arrival of law enforcement.

According to GunViolenceArchive.org, the US experienced more than 53,000 gun-related incidences in 2015, resulting in 13,426 deaths. In a recent report released by the Department of Justice, 160 mass shootings occurred between 2000 and 2013. Most recently, the mass shootings in Orlando, Fla. on Jun. 12, 2016, where 49 people were killed and 53 were injured further demonstrates the urgent need for a technology based sentinel and suppression approach.

Americans recognize their continued vulnerability at schools, in office buildings, places-of-worship, government buildings, and other public spaces as seen in the spike in sales of personal weapons that invariably follow each of the many gruesome mass shootings. The social impact of remedial or preventative efforts in this area will be immense, with the number of deaths resulting from active shooter scenarios reduced, and citizen peace of mind in living their day-to-day lives greater.

While personal protection and preventative approaches are well known, each has limitations but are nonetheless part-and-parcel of the commercial landscape. Arms manufacturers and/or dealers offer weapons for personal protection, however, even in light of numerous conceal and carry laws, intervention by trained, armed citizens is serendipity, hardly an option for development. Moreover, automatic locking doors, surveillance cameras, and alarm systems, as well as active means, such as armed security personnel, have been available and are well known. Be that as it may, and as recent history has shown, such approaches are not without their limitations and shortcomings.

In the context of heretofore known "systems," there are numerous teachings directed to threat detection and threat suppression. While inroads have been and continue to be made, it is to such limited systems and their shortcomings that present efforts are directed.

As to threat detection, there are products on the market that offer only gunshot notification and generalized localization: ShotSpotter Technology is an outdoor urban acoustic listening system that affixes to utility poles and can triangulate the source of a gunshot so that police can respond accordingly. Its localization capability is two-dimensional (x, y coordinates, such as an intersection of two streets) and not better than ten square meters. Another company operating in this space is Shooter Detection Systems, Inc., which sells acoustic and infrared sensors used in indoor spaces that are capable of identifying a gunshot and notifying the police via secure communications link as well as the occupants of the building via SMS text of the gunshot event. However, this system offers only one degree of localization (i.e., the room where the gun was fired). Finally, a variety of shooter detection teachings are known, and well suited for adaptation in furtherance of a robust detection, targeting, tracking and suppression solution, e.g., U.S. Pat. No. 7,965,868 (Roberts et al.), US Pub. No. 2014/0269199 (Weldon et al.), US Pub. No. 2015/0070166 (Boyden et al), and WO 2015/184219 (Khire et al.), each of which is hereby incorporated by reference in their entireties.

As to threat suppression, a variety of non-lethal tools exist for disrupting an individual, though each of them have inherent shortfalls that render such alternatives less effective in the context of an active shooter event. For example, a stun gun and a beanbag gun are non-lethal but both could cause serious injury or death, and are not suitable for sustained suppression. Tear gas and pepper spray can be rendered ineffective with a gas mask, and are ill advised for indoor use. Furthermore, tear gas and pepper spray do not differentiate between civilians, police, and the intended target. Moreover, concentrated and directional microwaves, so called Directed Energy Guns, are very costly and are not always non-lethal; concentrated and directional sound waves, known as sonic or ultrasonic weapons are generally unproven and while suitable for crowd dispersion, they cannot cause physical disruption because they create effects that are more of a nuisance rather than a substantive challenge that must be overcome.

As to multifunctional approaches (i.e., those characterized by threat detection and suppression), efforts to date generally rely upon disruption means. For example, U.S. Pat. No. 7,990,805 (Kumhyr et al.) combines detection with non-lethal chemical countermeasures, with US Pub. No. 2015/0061869 (Crowe et al.) combining detection with dispensing of a non-lethal water borne irritant. It does not appear that neither of these systems can detect a threat, identify/target the threat, track the movement of the threat, and effectively and immediately physically disrupt and suppress the threat via multiple directed and controlled suppression means.

In as much as shelter in place had been a best practice, confrontation in hopes of lessening causalities has become a prevalent theme in keeping with present discourse on the topic. With even the best response times, and the presence of armed authorities on site, there remains a need for an immediate, significant, discriminating and systematic suppression, cessation and/or counter attack measures.

SUMMARY OF INVENTION

A building monitoring and control system (i.e., an active shooter suppression system (ASSS)) in furtherance of engaging a detected and targeted threat to persons in or about the building is generally provided. The system is generally and fairly characterized by a threat detection module, a threat targeting module, and a threat tracking module, threat engaging assemblies operatively linked to either/both of the latter modules. The threat detection module, for detecting a threat present within the building and/or proximal thereto, is characterized by detection sensors selectively disposable within the building and/or within and proximal to the building. The threat targeting module, for locating a detected threat, is operatively linked to the threat detection module. The threat tracking module, for tracking a located threat, is characterized by tracking sensors selectively disposable within the building and/or within and proximal to the building, the threat tracking module operatively linked with the threat targeting module. The threat engaging assemblies, operatively disposable within the building and/or within and proximal to the building, are for selectively engaging the located and trackable/tracked threat. Each of the threat engagement assemblies advantageously but not necessarily, comprise water cannons characterized by selectively directable water discharge nozzles. The threat engagement assemblies are controllingly linkable, with the water cannons advantageously but not necessarily adapted to receive water from an existing water source (e.g., a fire suppression or adapted fire suppression system of the building), with the threat engagement assemblies operative linked and responsive to the threat targeting module and the threat tracking module in furtherance of disrupting a located and trackable/tracked threat with water discharged from multiple water discharge nozzles.

Through the modification of a facility's fire suppression system, the ASSS can identify the shooter, triangulate his location, and concentrate multiple high-pressure water streams at a shooter so targeted. The high-pressure water is intended to disrupt the shooter thereby, allowing people to escape or overtake the shooter in an effort to stem the carnage. This invention is intended to provide people in public spaces with non-lethal "covering fire" in the form of high-pressure water.

The contemplated system/method is intended to suppress an active shooter through the use of a high-pressure, multi-directional robotic water cannon. This robotic system is generally, but not exclusively, characterized by two primary systems: a detection, targeting and tracking system/network and, a non-lethal high-pressure water suppression system. Advantageously, but not necessarily, a robotic network characterized by a plurality of robots is contemplated. The system or network is advantageously, but not exclusively intended to be installed along-side a building's pre-existing fire suppression system, and is designed to disrupt the shooter(s) through the use of a high-pressure water stream.

In light of the threat posed by active shooters in schools, movie theaters, places of worship, work places, and other spaces, the contemplated system is intended to significantly disrupt the active shooter and afford potential victims the chance to escape or counter-attack. The ASSS is a stand-alone programmable robotic system and/or network capable of carrying out a complex series of actions automatically. When three or more units/modules are operatively linked together via CAT-5 cable or the like, the network of automated, fully articulating, high-pressure water cannons, advantageously but not necessarily built into a fire-suppression system, become effective. The network of robots passively monitors an environment through the use of noise and light sensors. Based on the signature of a discharging weapon, the network contemplates uses an advanced acoustic dead reckoning methodology or raw IR data in keeping with known approaches to locate the shooter. Upon "positive identification" of the shooter, the system will direct the water cannons towards the target and engage same with high-pressure water. The ASSS will photograph the shooter and maintain multiple streams of high-pressure water on the assailant, even if no additional shots are fired.

Presently, triangulation technology exits, however, special adaptations are utilized for this application. The targeting system will be a collection of sensors located around/about a room/building space. These sensors will be capable of identifying the signature characteristics of a weapon discharge (e.g., light, heat, and/or sound). It will be waterproof. The sensors will also incorporate the use of cameras that will enable the system to track the target after the characteristics of the weapons discharge are no longer present. The water suppression system will follow the assailant thought the use of a network of fully articulating 360 degree high pressure water nozzles located in the ceiling, alongside the fire suppression system. Finally, it is further contemplated that the system/network will employ the use of cloud computing so the system can be monitored remotely, which can also notify local law enforcement and emergence medical services personnel, when the system is activated. By using pre-existing building infrastructure, this present invention requires limited building modification. More specific features and advantages obtained in view of those features will become apparent with reference to the drawing figures and DETAILED DESCRIPTION OF THE INVENTION.

BRIEF DESCRIPTION OF THE DRAWINGS

FIG. 7 depicts a high pressure water dispensing assembly characterized by a directable nozzle;

DETAILED DESCRIPTION OF THE INVENTION

Figure 9:
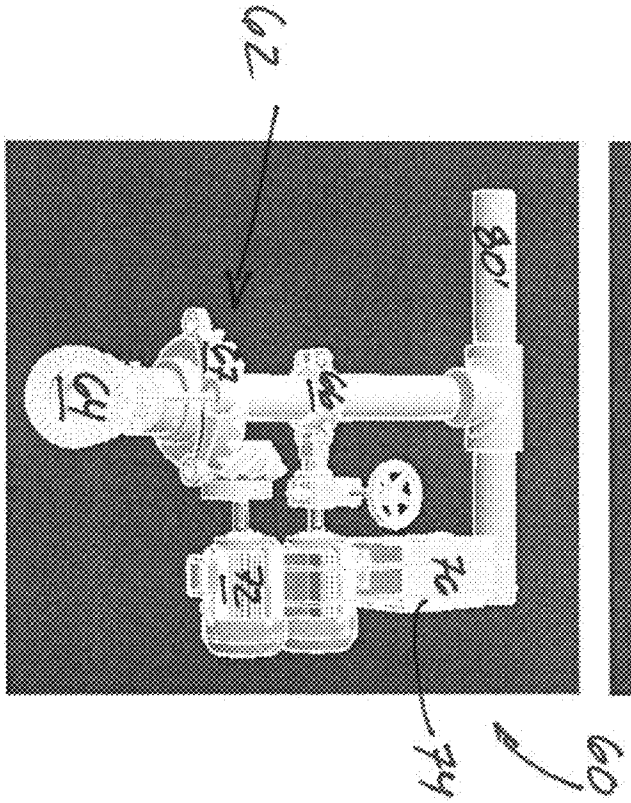
FIG. 9 depicts the assembly of FIG. 8 as viewed from below.
Figure 10:
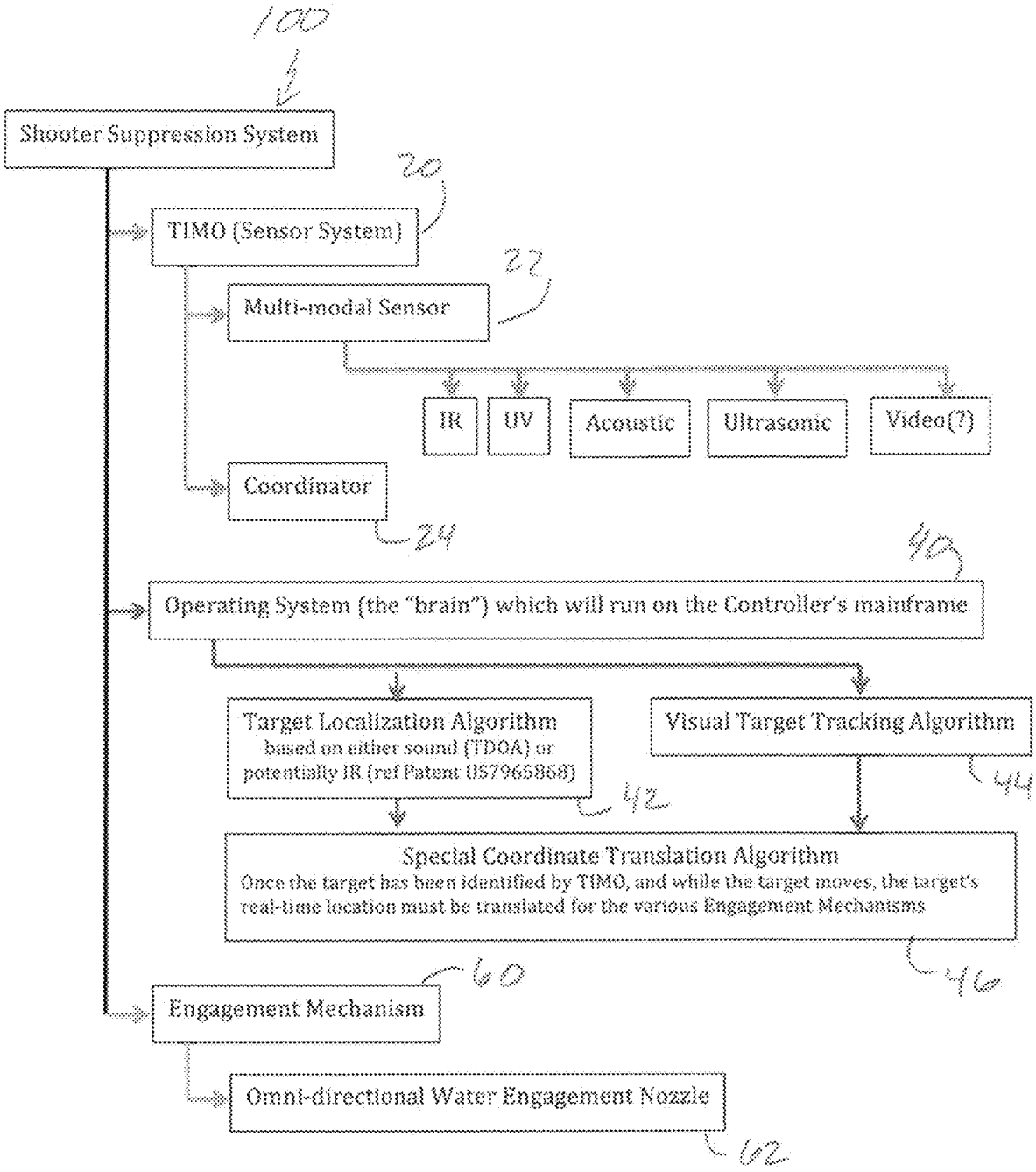
FIG. 10 depicts a representative, non-limiting relational graphic for the contemplated active shooter suppression system; and, FIG. 11 depicts a representative, non-limiting operational flow chart for the contemplated active shooter suppression system.
Figure 11:
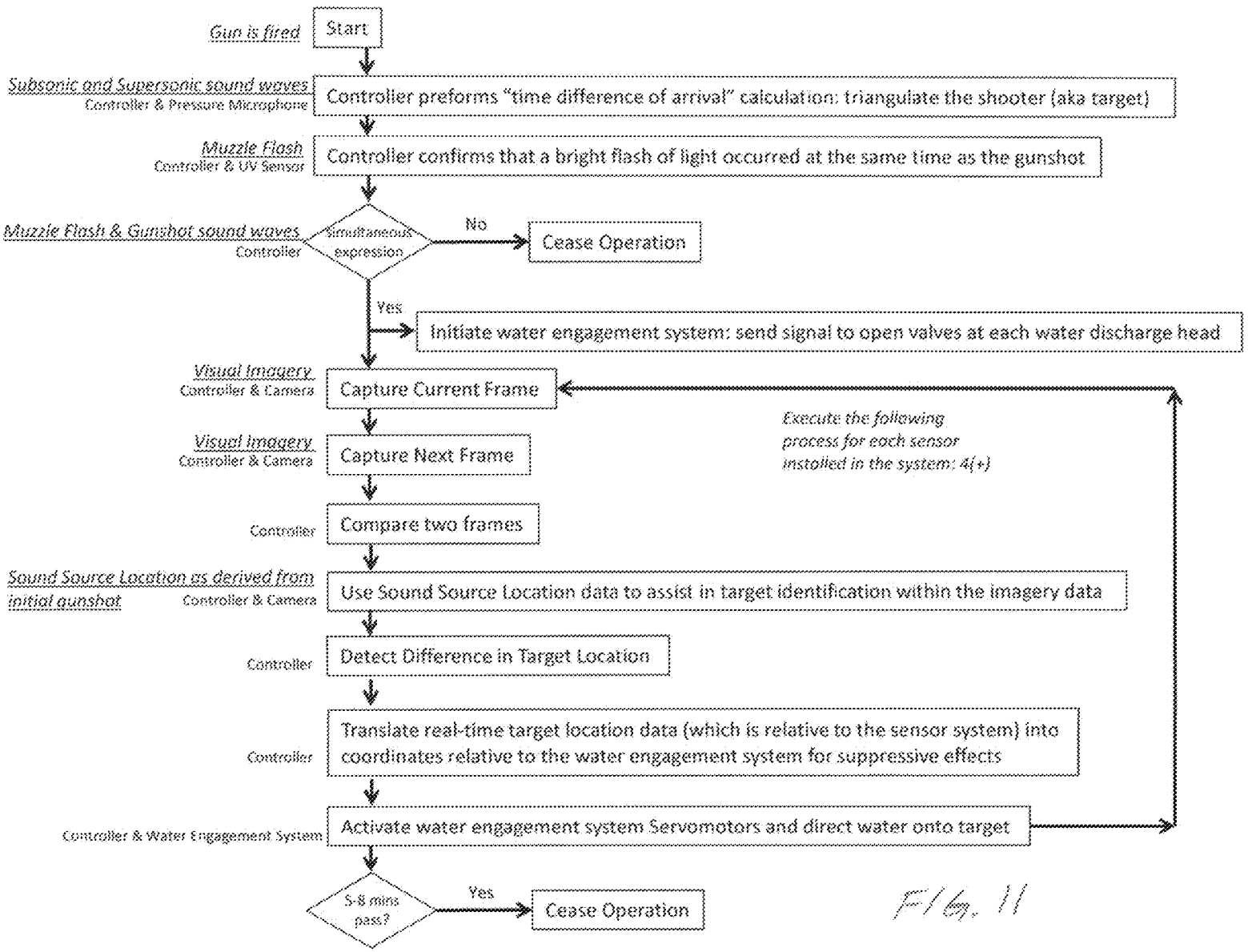

As a threshold matter, the instant disclosure proceeds with initial reference to the graphic representations of FIGS. 10 & 11 which visually depict system elements, and relationships for between and among same (FIG. 10), and an operational process overview (FIG. 11). Thereafter, disclosure proceeds in connection to system functionality, namely, detection, targeting and tracking, as per the depictions of FIGS. 1-6, and thereafter to suppression as per the representative non-limiting depictions of FIGS. 8 & 9.

The contemplated active shooter suppression system (ASSS), in the form, for example, of a building monitoring and control system 100, is notionally characterized by three integrated operative systems, namely, a sensing system 20, an operating system 40 and a suppression system 60 (FIG. 10). Broadly, and notionally, the operator system selectively processes inputs having origins in at least the sensing system and thereafter engages at least the suppression system in furtherance of suppressing an active shooter. Sensing system 20 may be generally and fairly characterized by or embodied as a threat detection module, operator system 40 by or embodied as a combination of threat targeting 42 and threat tracking modules 44 and a coordinate translation processor 46 or the like, and suppression system or network 60 by or embodied as threat engaging assemblies, advantageously in the form of omni-directional high pressure water cannons 62. The system is advantageously powered by an "off-grid" supply of power to ensure activation/operation. The system is readily monitorable with immediate notifications issuing to designated authorities.

Threat detection module 20 is generally characterized by sensors, in the form of an array or network, more particularly and advantageously, a multi-modal sensor array 22. Moreover, the threat detection module is generally and characterized by a coordinator 24, namely, a processor or the like dedicated to the processing and/or tracking of data/information having origins in or associated with sensors of the sensor array/network.

The threat detection module, having a basis in the teaching of U.S. Pat. No. 7,965,868, incorporates multiple modes of sensing and an algorithm in furtherance of acquiring shooter locations. The multi-modal sensor (mms) network advantageously, but not exclusively, is characterized by infrared, UV, acoustic, and ultrasonic sensors. The mms network detects and qualifies shooting events by classifying the sequence of events with respect to the shooting action, the infrared signature followed by an ultrasonic signature followed by an acoustic signature references a shooting event. the system accept or reject the shooting events by classifying sensor information.

The coordinator for the mms network or units includes, among other things, distance information between the mms units and/or elements thereof. The coordinator furthermore differentiates between the sequences of sensed magnitudes to establish a relative time difference between acoustic events from the connected mms units specifically if the mms units are located within the same room by triangulating the position of a potential shooter. In one dimensional space, two mms units are connected to one coordinator and extract the location information of a threat in the single dimensional space, with 4 mms units contemplated to triangulate the location of a threat.

The outputs of multi-modal sensors corresponding to the same magnitude such as acoustic signature can be compared in time, with the time difference between acoustic signatures corresponding to relative spatial difference or the relative distance between the threat and the multi-modal sensor units. Moreover, this data can be used to differentiate between the locations of multiple shooters or a single shooter moving in three-dimensional space, or the two dimensional or three dimensional location, and the motion of the shooter in the three-dimensional space. An algorithm, running on the coordinator, is advantageously utilized to reduce or minimize the spatial uncertainty or spatial error by taking multiple references to triangulate the threat location or the change in the location of the threat.

It is further contemplated to provide software, running on a portable device such as a mobile phone, or custom hardware, which emulates the signatures which are generated by a threat to calibrate and configure the sensor system. A software learning algorithm, running on the coordinator, executes contemplated triangulations while the emulator is running and collecting multiple data points as training vectors for determining the optimal coefficients for the triangulation algorithm.

Turning now to operating system 40 and its components, both threat targeting and tracking are contemplated, with information/particulars as to same input or otherwise leveraged in furtherance of select actuation of actuatable threat engagement assemblies. With respect to target identification, an analyses of the Time-of-Arrival (ToA) and Angle-of-Arrival (AoA) of the sound waves of a sub-sonic or supersonic bullet is employed. The contemplated target identification algorithm uses an analysis of the ToA and AoA of the sound waves from a discharging weapon taken from three or more sensors so as to reveal the sound source's "3-Degrees of Freedom" position (3DoF, i.e., specific point in space, or its x, y, z coordinates) to an accuracy of one-square meter.

An emerging contemplated capability, a Rapid Image Matching Analysis (RIMA) algorithm, while based on other similar visual object tracking technology, will be used to specifically track the shooter who is not emitting a self-identifying signal. Whereas GPS and cell phone triangulation are examples of localization based on signals emitted from an electronic device, the active shooter will not be emitting a self-identifying signal. Sonar and radar are examples of locating objects through the use of echo characteristics of sound waves or radio waves, and these systems work well in open-ocean (as used by submarines) or open air (as used by airplanes), but will not work in an enclosed and busy space such as classroom or a conference room. The contemplated RIMA algorithm aims to determine the new and renewed locations of the target as it moves, and then translate that new location to the threat engaging mechanisms/assemblies to physically disrupt and suppress the shooter.

With general reference now to FIGS. 1-6, a system or network of sensors 22 (FIGS. 1 & 2) is advantageously located throughout a room, e.g., around the upper perimeter of a room, along with omni-directional water cannons 62 (FIGS. 3-6). These sensors are able to detect key characteristics of a discharging weapon: e.g., and without limitation, heat, sound, and/or light. The sensors or sensing stations include cameras for capturing image of the assailant and for maintaining that image for use during targeting.

After the first shot is fired, and consistent with the operations of FIG. 11, the high pressure water system is activated. In addition, local police and EMS personnel are noticed. The water system dispenses water within a range of about 2500-5000 psi from each port or nozzle of the water cannon. As the assailant moves through the space, the sensors relay the location information to the high pressure water system and the assailant continues to be suppressed with hundreds of gallons of water per second.

The water nozzles may be advantageously but not necessarily built into pre-existing fire-suppression system infrastructure. The water nozzles are fully articulating/omni-directional and networked together to provide the highest concentration of water pressure possible to thwart the assailant. The water is intended to make it very difficult for the assailant to aim his weapon, reload his weapon or otherwise act towards a harmful end. The high-pressure water system is designed to provide sufficient disruption of the active shooter for victims to either escape or counter-attack, regardless of the shooter's movement or location.

Figure 1:
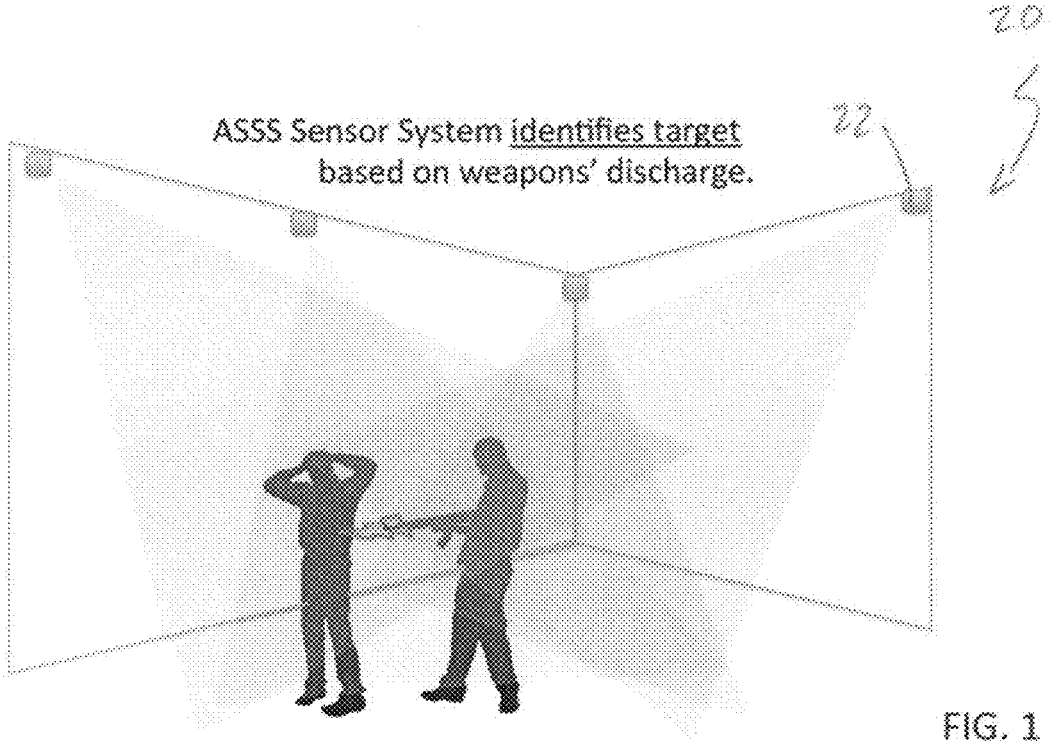
FIGS. 1-6 are a sequence of illustrations depicting ASSS functionality.
Figure 2:
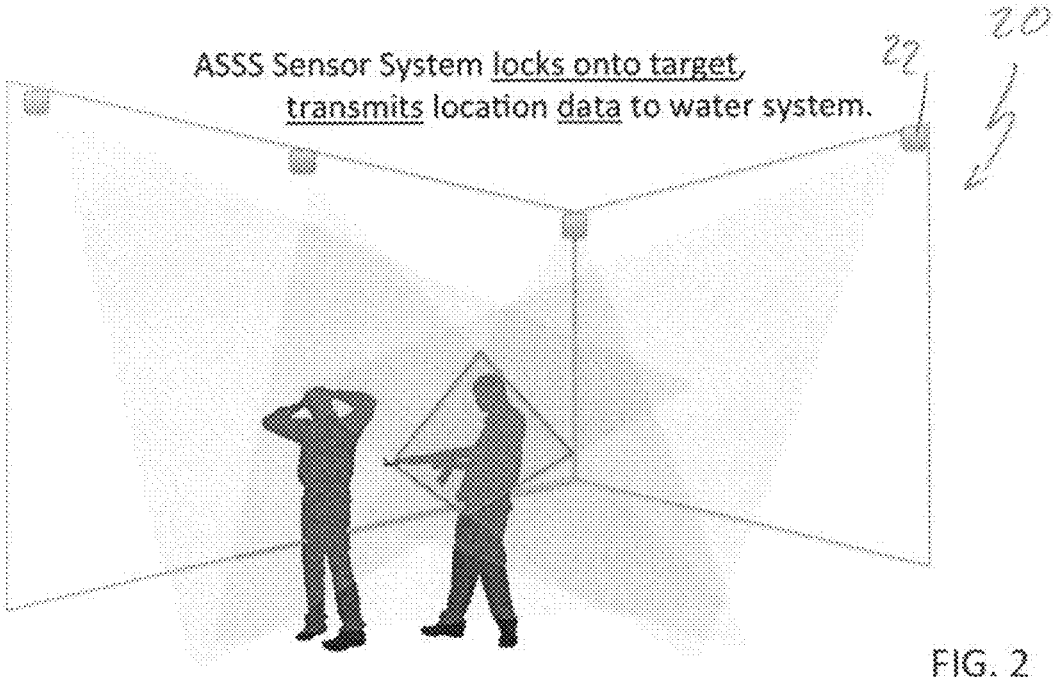
Figure 3:
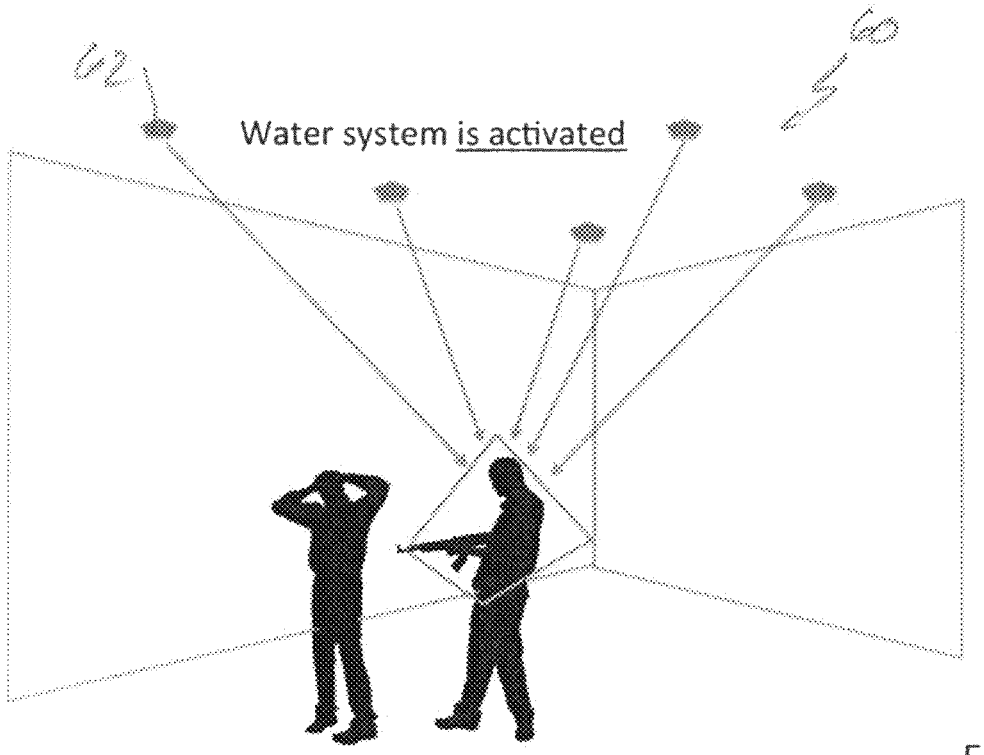
Figure 4:
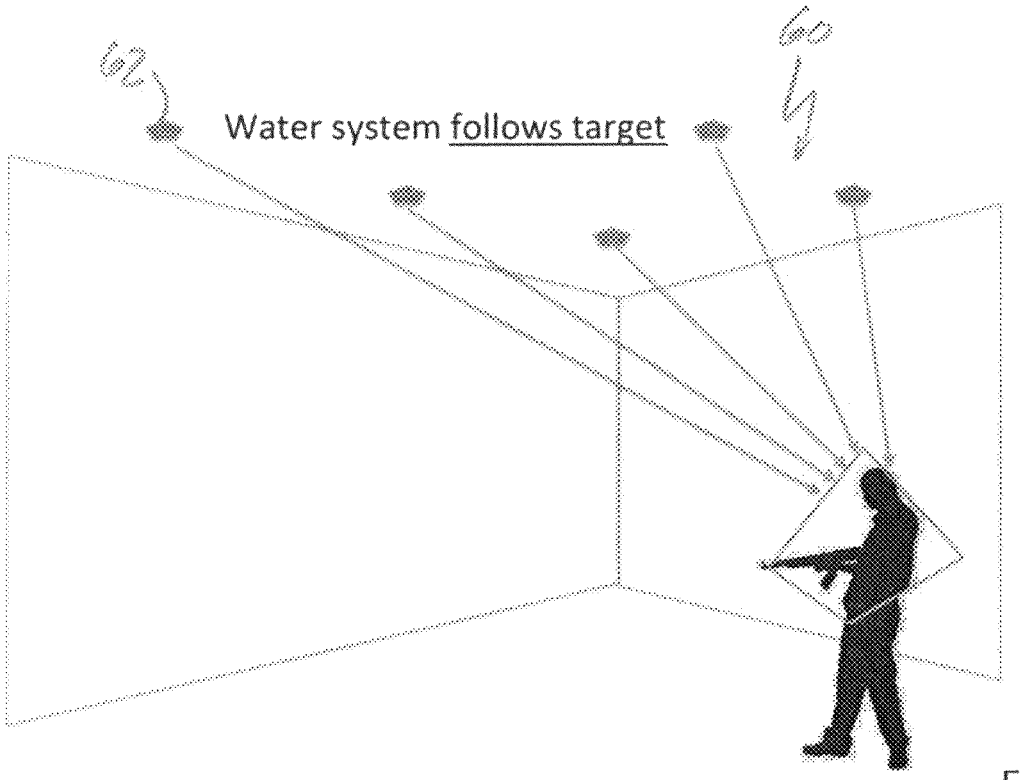
Figure 5:
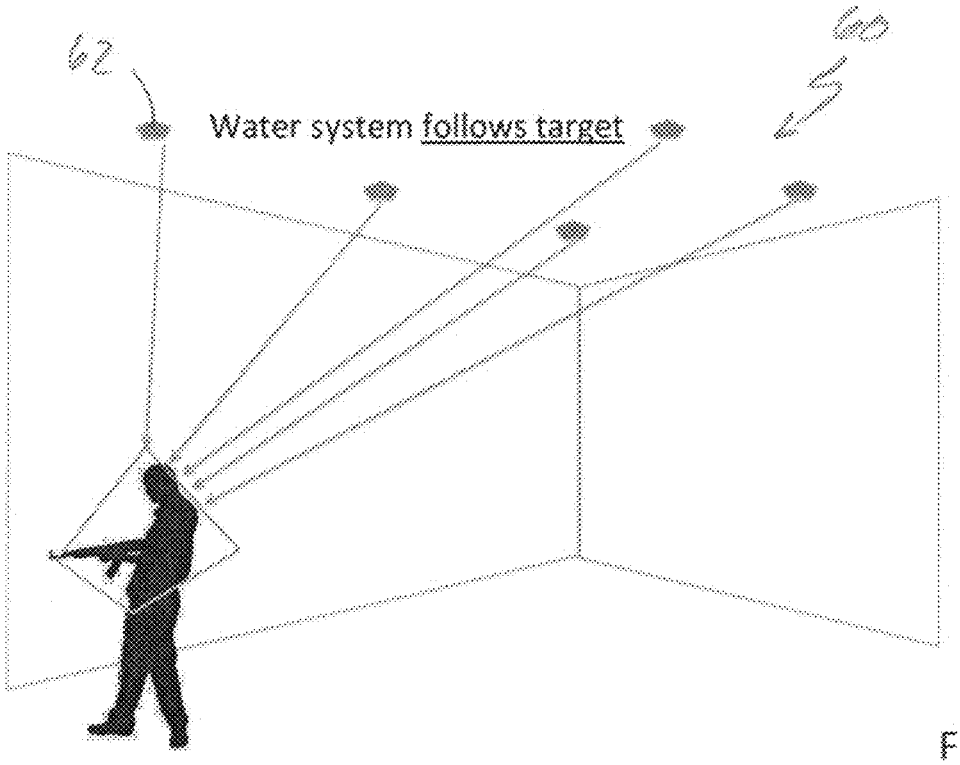
Figure 6:
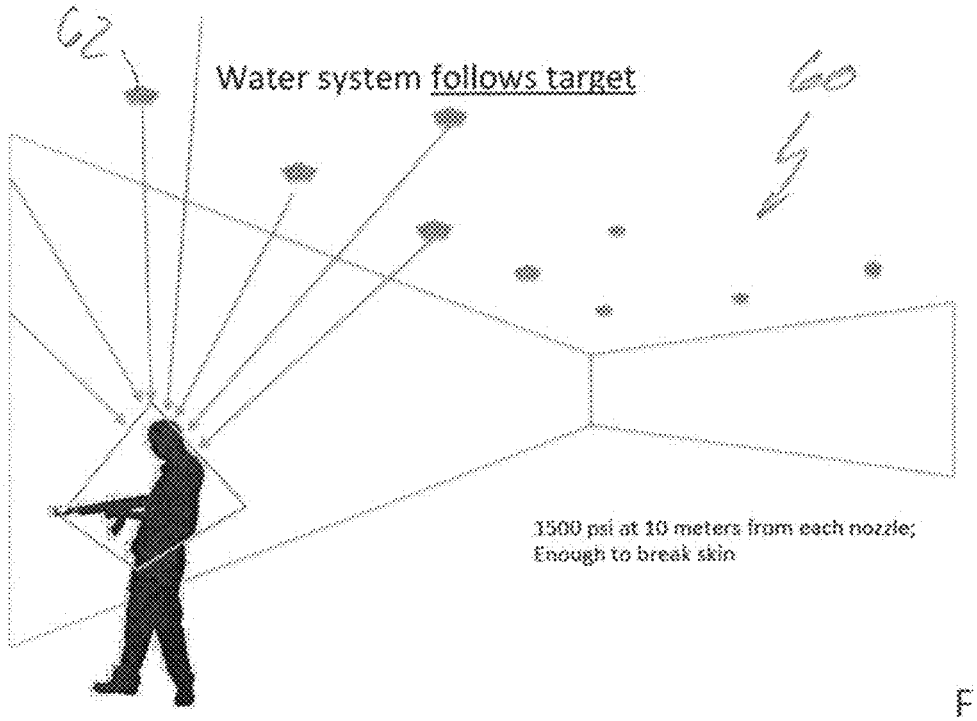
Figure 8:
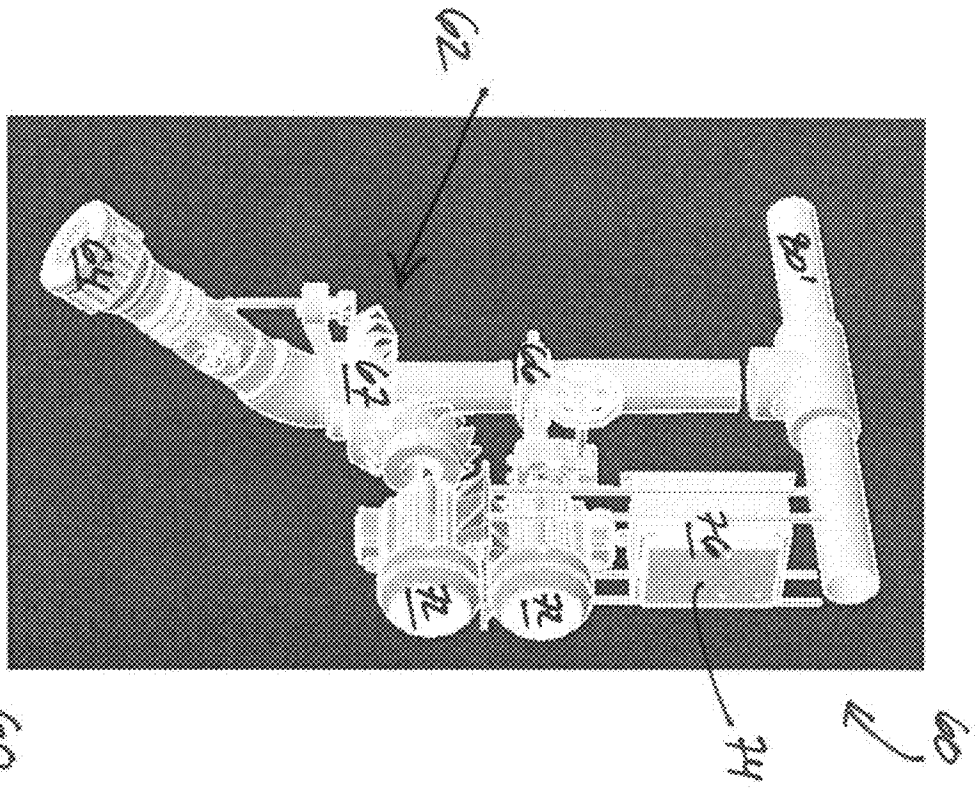
FIG. 8 depicts an alternate high pressure water dispensing assembly characterized by a directable nozzle.

A contemplated high pressure water dispensing assembly 60 is advantageously but not exclusively characterized by a water cannon 62 characterized by a directable nozzle 64 as is generally shown in FIGS. 7 & 8. An actuatable valve 66 operatively links the assembly with water source 80, with a pivot mounting 68 for the nozzle, and a carriage 68 for translatingly supporting the pivotably mounted nozzle further provided. The actuatable mechanisms, e.g., the water supply valve, nozzle deployment carriage, and nozzle pivot/rotation mounting, are each actuated by individual servo motors 72, the motors operatively linked via controller 74.

These motors are calibrated upon installation, and receive directional information from the targeting software based on data provided by the sensor system.

A further/alternately contemplated high pressure water dispensing assembly characterized by a directable nozzle is generally shown in FIG. 8 and the alternate view of FIG. 9. More particularly, the high pressure water dispensing assembly of FIG. 8 represents that portion of the ASSS as it might look after being installed into a pre-existing fire suppression pipe 80'.

The system/assembly is characterized by an array of sensors, a triangulation computer located inside the junction box, and an articulating, fully-rotating high-pressure water nozzles powered by an "off grid" power supply, similar to how exit signs and emergency lighting is powered. Once initiated, the system will immediately notify police and emergency responders in an effort to reduce the time between first shot and first responder. The sensors of the array, located for instance behind the water nozzle at ceiling level, include, but are not limited to noise, shockwave and light sensors. These sensors are able to detect the key characteristics of a discharging weapon: e.g., and without limitation, sound, shockwave, and muzzle flash. The sensors also include a camera that will be used to capture the image of the assailant and maintain that image for the purpose of tracking the target.

After the first shot is fired, the sensors register the shot and the water system is activated. The water system directs a concentrated stream of water in excess of 150 psi and 100 gpm at an average distance of 10 meters. As the assailant moves through the space, the sensors relay the location information to the water system and the assailant continues to be suppressed with water (as per FIGS. 1-6). The water is intended to make it difficult for the assailant to aim the firearm as there will presumable be water in the face and eyes of the shooter. In the view of FIG. 9, there is shown a motor activated open/close valve 66, a bevel gear set 67, a rotating union 68, a linear actuator 70, electric motors 72 and a junction box 76 housing the power hub and targeting processor/processor components. The vertical movement of the nozzle, and the horizontal rotation of the nozzle are advantageously but not necessarily separately controlled. These motors are calibrated upon installation, and receive directional information from the targeting software based on data provided by the sensor system.

The ASSS is the integration of at least two systems thereby creating one stand-alone robotic system or network. The two primary systems include: a detection, targeting and tracking system, and the non-lethal high-pressure water suppression system. Further contemplated features include, but are not limited to:

means of identifying an active shooter thorough the signature characteristics of a discharged weapon: e.g., heat, light, sound, and/or shockwave;

means of locating the shooter through reverse acoustic dead-reckoning, triangulation or other means based on the discharging weapon;

means of activating multiple high-pressure water nozzles;

means of being installed into a building's pre-existing fire suppression system;

means of contacting first responders immediately upon activation;

means of directing the water nozzles onto a designated target(s) through automatic rotation and linear articulation of the water nozzle;

means of tracking the target though image matching, and maintaining a constant stream of water on the target while the target moves;

means of monitoring the power to the ASSS and the water pressure in the system through cloud computing;

means of the sensors and computing system being waterproof and working while water system is activated;

means of being fire-grade, as to not compromise the fire sprinkler systems if the ASSS valve fails;

means to prevent accidental/inadvertent discharge;

means of being powered by "off grid" power supply, similar to exit signs and emergency lighting; and, means of being selectively and/or remotely deactivated.

While advantageous, non-limiting systems, apparatus, assemblies, devices, mechanisms, methods, etc. relating to an active shooter suppression system are depicted, described and/or readily ascertained with reference to the instant disclosure, alternate not insubstantial functional equivalents are likewise contemplated to effectuate threat detection, targeting, tracking and suppression. Presently known and future developed means for effectuating the noted contemplated functionalities are understood to be within the scope of the instant disclosure.

Thus, since the structures of the assemblies/mechanisms disclosed herein may be embodied in other specific forms without departing from the spirit or general characteristics thereof, some of which forms have been indicated, the embodiments described and depicted herein/with are to be considered in all respects illustrative and not restrictive. Accordingly, the scope of the subject invention is as defined in the language of the appended claims, and includes not insubstantial equivalents thereto.

What is claimed is:

1. A building monitoring and control system in furtherance of engaging a detected and targeted active shooter threat in relation to the building, the system comprising:

a. a threat detection module configured to detect an active shooter threat present within the building and/or proximal thereto, said threat detection module characterized by detection sensors selectively disposable within the building and/or within and proximal to the building;

b. a threat targeting module configured to locate a detected active shooter threat, said threat targeting module operatively linked to said threat detection module;

c. a threat tracking module configured to track a located active shooter threat, said threat tracking module characterized by tracking sensors selectively disposable within the building and/or within and proximal to the building, said threat tracking module operatively linked with said threat targeting module; and, d. threat engaging assemblies, operatively disposable within the building and/or within and proximal to the building configured to selectively engage the located and trackable active shooter threat, each of said threat engagement assemblies comprising water cannons characterized by selectively directable discharge nozzles, said threat engagement assemblies controllingly linkable, said threat engagement assemblies operative linked and responsive to said threat targeting module and said threat tracking module in furtherance of disrupting a located and trackable active shooter threat with water discharged from multiple water discharge nozzles of said water cannons.

2. The building monitoring and control system of claim 1 further comprising a threat communication module, said threat communication module operative linked with said threat detection module, said threat communication module altering select entities of detection of an active shooter threat.

3. The building monitoring and control system of claim 1 wherein said threat detection module includes a coordinator, said coordinator storing information as to said detection sensors.

4. The building monitoring and control system of claim 1 wherein said threat detection module includes a coordinator, said coordinator storing information as to said detection sensors and processing said stored information and received data from said detection sensors.

5. The building monitoring and control system of claim 1 further comprising an operating system, said operating system characterized by said threat targeting module and said threat tracking module.

6. The building monitoring and control system of claim 1 further comprising an operating system, said operating system characterized by said threat targeting module, said threat tracking module and a coordinate translation module for processing output from one or both of said targeting and tracking modules.

7. The building monitoring and control system of claim 1 wherein said threat targeting module employs a time-of-arrival analysis relative to sound waves associated with a fired weapon.

8. The building monitoring and control system of claim 1 wherein said threat targeting module employs an angle-of-arrival analysis relative to sound waves associated with a fired weapon.

9. The building monitoring and control system of claim 1 wherein said threat targeting module employs a time-of-arrival analysis and an angle-of-arrival analysis relative to sound waves associated with a fired weapon.

10. The building monitoring and control system of claim 1 wherein said detection sensors comprise a sensor array.

11. The building monitoring and control system of claim 1 wherein said detection sensors delimit a sensor network.

12. The building monitoring and control system of claim 1 wherein said detection sensors comprise multi-modal sensors selected from the group consisting of infrared, ultra violet, acoustic, ultrasonic, photo and video.

13. The building monitoring and control system of claim 1 wherein said detection sensors comprise multi-modal sensors, a shooting event detected and qualified thereby via classifying an event sequence associate with the shooting event.

14. The building monitoring and control system of claim 1 wherein said water cannons are adapted to receive water from a fire suppression or adapted fire suppression system of the building.

15. The building monitoring and control system of claim 1 wherein said water cannons are adapted to receive water from a water source of the building.

16. The building monitoring and control system of claim 1 wherein said water cannons are adapted to receive water from a water source independent of a water source of the building.

17. The building monitoring and control system of claim 1 wherein said water cannons are translatably deployable from a standby condition to an active condition.

18. The building monitoring and control system of claim 1 wherein said water cannons are rotatingly actuatable.

19. The building monitoring and control system of claim 1 wherein said selectively directable nozzles are pivotingly directable.

20. The building monitoring and control system of claim 1 wherein said selectively directable nozzles are rotatingly directable.

* * * * *